US006367204B1

(12) United States Patent
Eichler

(10) Patent No.: US 6,367,204 B1
(45) Date of Patent: Apr. 9, 2002

(54) METHOD AND APPARATUS FOR DECORATING DOORS

(76) Inventor: Donald Lewis Eichler, 129 Gregory Pl., Grand Island, NY (US) 14072

( * ) Notice: Subject to any disclaimer, the term of this patent is extended or adjusted under 35 U.S.C. 154(b) by 0 days.

(21) Appl. No.: 09/503,277

(22) Filed: Feb. 14, 2000

(51) Int. Cl.[7] ..... E06B 1/34

(52) U.S. Cl. ..... 52/3; 52/660; 52/664; 52/656.8; 52/456; 160/90; 160/368.1

(58) Field of Search ..... 52/456, 660, 656.8, 52/664; 40/594, 603, 611; 160/90, 368.1; 211/94.02, 97, 113, 117, 119.004; 362/145, 152, 249, 252, 806; 24/306

(56) References Cited

U.S. PATENT DOCUMENTS 3,355,030 A * 11/1967 Cathcart ..... 211/119.004
4,894,889 A * 1/1990 Johnson et al. ..... 24/68 CT
5,398,436 A * 3/1995 Suzuki ..... 40/558
5,537,793 A * 7/1996 Muraski ..... 52/585.1
5,548,878 A * 8/1996 Romagnoli ..... 24/306
5,839,237 A * 11/1998 Davidson ..... 52/3

* cited by examiner

*Primary Examiner*—Carl D. Friedman
*Assistant Examiner*—Phi Dieu Tran A
(74) *Attorney, Agent, or Firm*—Arthur S. Cookfair

(57) ABSTRACT

Apparatus for displaying images on doors especially sectional overhead garage doors comprises a lattice of interconnected horizontal and vertical members removably attached to each horizontal door panel. The horizontal members are looped around the top and bottom of the panel and detachably joined at the back of the panel to form a complete loop. The horizontal members are held by removable attachment to the vertical members on the outer side of the panel using split pin connectors as a means of attachment. The pin connectors may also be used as an attachment point for lighting displays.

7 Claims, 3 Drawing Sheets

METHOD AND APPARATUS FOR DECORATING DOORS

BACKGROUND OF THE INVENTION

1. Field of the Invention

This invention relates to a method and apparatus for displaying images on doors.

2. Prior Art

It is known to apply decorative covers, signs, or various displays to buildings, especially at the entrance or doors of buildings, for example, to display advertising or announcements, or to provide decorations for various festive occasions. On residential homes, as well as on commercial buildings, doors, especially large doors, such as garage doors, provide a space that may be useful for such purposes. Typically, decorations, displays, or signs are placed on such doors in a manner that requires a more or less permanent change in the appearance or the integrity of the door. For example, signs or other decorations may be applied to a door by painting, or attaching, such as with screws, nails or the like. Generally, when a sign or decoration is applied to a door by such methods, it cannot be conveniently removed or changed without adverse effect on the appearance or integrity of the door. A still further problem is encountered when it is desired to use the large space on a garage door for decorative purposes since most garage doors are of sectional construction. That is, they are commonly constructed in horizontal segments, hingedly attached to each other and movably fastened by means of rollers to vertical tracks on each side. Because such doors are designed to bend or flex during opening or closing, difficulty is encountered in removably attaching a cover, such as a sign or decorative display, to the outer surface of the door in a manner that will allow the cover to bend or flex with the segmented door during opening or closing.

U.S. Pat. No. 1,452,074 to Evens, discloses a segmented sign that moves vertically with individual sections or letters of the sign having attachments that are held in place between the segments U.S. Pat. No. 2,153,924 to Haines discloses an aerial sign construction designed with individual sections being detachable and interchangeable. The individual sections, such as letter displays, are attached between two horizontal flexible parallel lines.

U.S. Pat. Nos. 5,649,390 and 5,839,237 to Davidson disclose decorative cover for garage doors wherein the cover is draped around the front of the garage door and the top and bottom of the cover are wrapped around and joined at the back side of the door.

It is an object of this invention to provide a method and apparatus for displaying images on doors.

It is a further object to provide a method and apparatus for displaying images on sectional overhead doors that will allow the door to be opened and closed while the displayed images remain in place on the door.

It is a still further object to provide a method and apparatus for decorating a door wherein a decoration may be conveniently attached and removed and or changed without affecting the integrity of the door.

SUMMARY OF THE INVENTION

The present invention provides a method and apparatus for displaying images on doors, whereby a lattice of interconnected horizontal and vertical members is removably attached to a door or door panel. At least one set of the lattice members, either the horizontal or vertical members, is looped around the door or panel and joined on the inside of the door or panel to form a complete loop. The members of the other set are held by removable attachment to the looped members on the outer face of the door, forming a rectangular lattice structure or grid thereon. It is preferred, especially for use on sectional overhead doors, to form a lattice wherein the vertical members are looped around the door or door panel and the horizontal members are held by removable attachment to the vertical members. The interconnection of the horizontal and vertical members imparts a rigidity and stability to the lattice structure and provides sites for attachment of image-creating or decorative items, such as signs, panels, posters, lighting arrangements, and the like. Since the looped members loop around the door and connect on the inner side of the door to form a complete loop, they are formed of a flexible material, thin and flexible enough to pass around the door or door panel without interfering with the opening and closing of the door. The looped members may be designed so that the portion of a looped member that is situated on the outer face of the door is more or less rigid and may be thicker, while the portion of the member that crosses the top and bottom or sides of the door or door panel is flexible and sufficiently thin that it will not interfere with the opening and closing of the door. Various materials that may be used in the fabrication of the looped members include wire, cloth, plastic, and the like, preferably in the form of a strap, belt or the like. The preferred material is a plastic, such as polyethylene, polypropylene, or most preferably, polyvinyl chloride, in the form of a strap, preferably one to three inches in width. The looped member may be secured to itself on the inner side of the door panel by various attachment means such as, buckles, buttons, snaps, pins, knots, hook and loop fasteners, and the like that may be conveniently fastened and unfastened. In one embodiment, all or a portion of each looped member may be of an elastic material to aid in maintaining a tight loop around the door panel. In a preferred embodiment, the looped members may be formed as a combination of two materials: a relatively rigid material, such as rigid polyvinyl choride, on the outer face of the panel and a relatively flexible material, such as polypropylene belting, on the portion passing between door panels and extending to the inner face of the panel where the two ends of the belting may be fastened by means of a buckle to form a complete loop.

The spacing and number of looped members may vary depending on the dimensions of the door panel and the degree of rigidity desired in the final structure. Typically for a vertical door of about 32–36 inches in width, two or three vertical looped members will suffice. For a horizontal panel of a one or two car sectional garage door, three to six vertical looped members may be sufficient.

The non-looped horizontal members are preferably rigid or semi-rigid and may be made, for example, of wood, metal, plastic or the like and may be attached to the looped vertical members, preferably in a removable manner, by means of clips, pins, buttons, snaps, hook and loop fasteners, split pin connectors, or the like to form a removable framework on the outer face of a door suitable for fastening a display thereon. The width (vertical dimension) of the horizontal member may vary considerably depending on the display to be created and may range, for example from an inch or less to form a lattice, or to the height of the door panel to forma complete covering of the panel. In the latter case, the complete covering may be a decorative cover, bearing letters, designs, pictures or the like.

A lattice structure, formed on a door panel in accordance with the present invention, may be fitted with fastening devices to attach image creating or decorative items, such as signs, posters, lighting or the like. The items may be removably attached with the use of split pins, adhesive, magnets, buttons, snaps, hook and loop fasteners, etc. In a preferred embodiment, the lattice structure of the present invention may be used to hold a lighting display using one or more strings of "Christmas Tree" lights.

BRIEF DESCRIPTION OF THE DRAWINGS

The present invention and the manner in which it may be practiced is further illustrated with reference to the accompanying drawings wherein.

DETAILED DESCRIPTION OF THE INVENTION AND PREFERRED EMBODIMENTS

Figure 1:
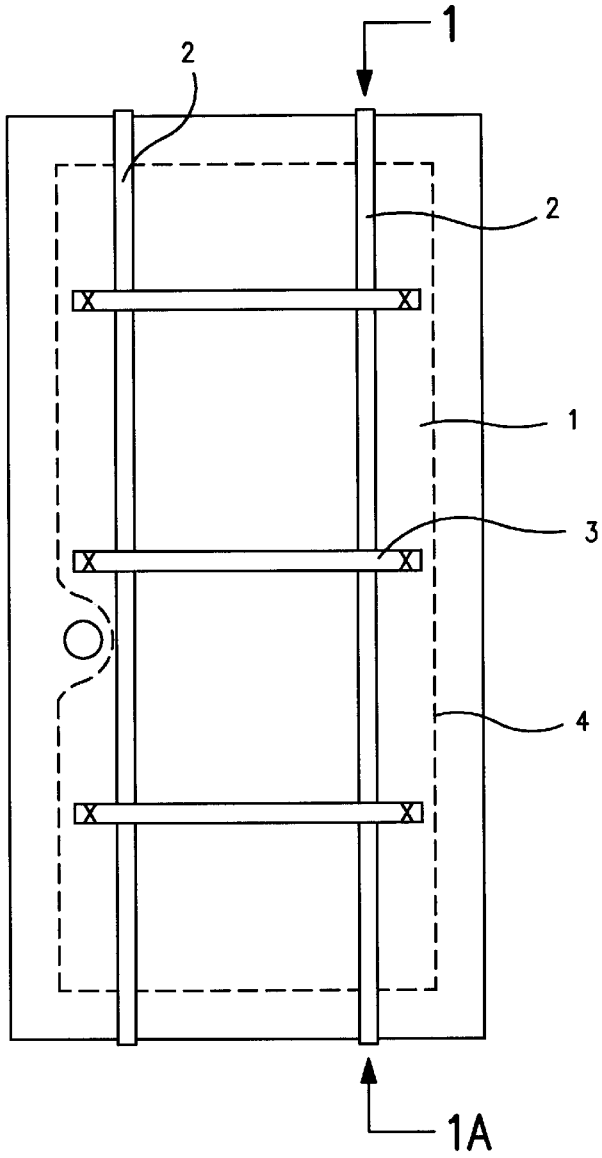
FIG. 1 is front view of residential entranceway having a lattice structure in accordance with the present invention attached to the door.
Figure 2:
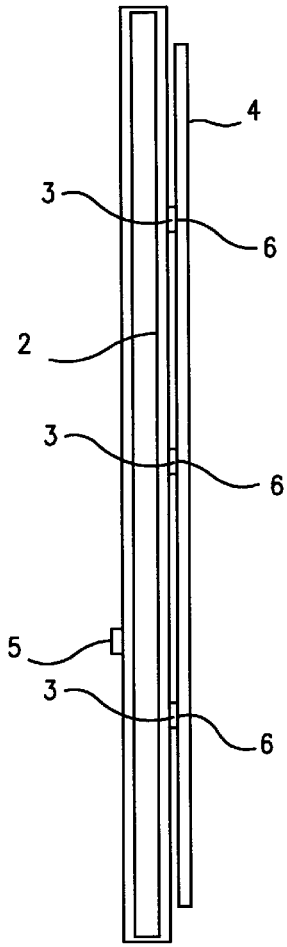
FIG. 2 is a side cross-sectional view of the lattice structure and door of FIG. 1 taken along the line 1–1A.

With reference to the drawings, and more particularly to FIGS. 1 and 2 thereof, there is illustrated a building entryway door 1 to which is attached a lattice structure comprising vertical members 2 and horizontal members 3 in accordance with the present invention. The vertical members 2 are looped around the top and bottom of door 1 and joined by a hook and loop fastener 5 at the back side of the door. The vertical members 2 are removably attached to the horizontal members 3 by fasteners (not shown) such as snaps or hook and loop fasteners. A display panel 4, shown in cross-section in FIG.2 and in outline in FIG. 1, suitable for presenting a decorative image, festive greeting or the like, is removably attached to the horizontal members 3 with the aid of hook and loop fasteners 6.

Figure 3:
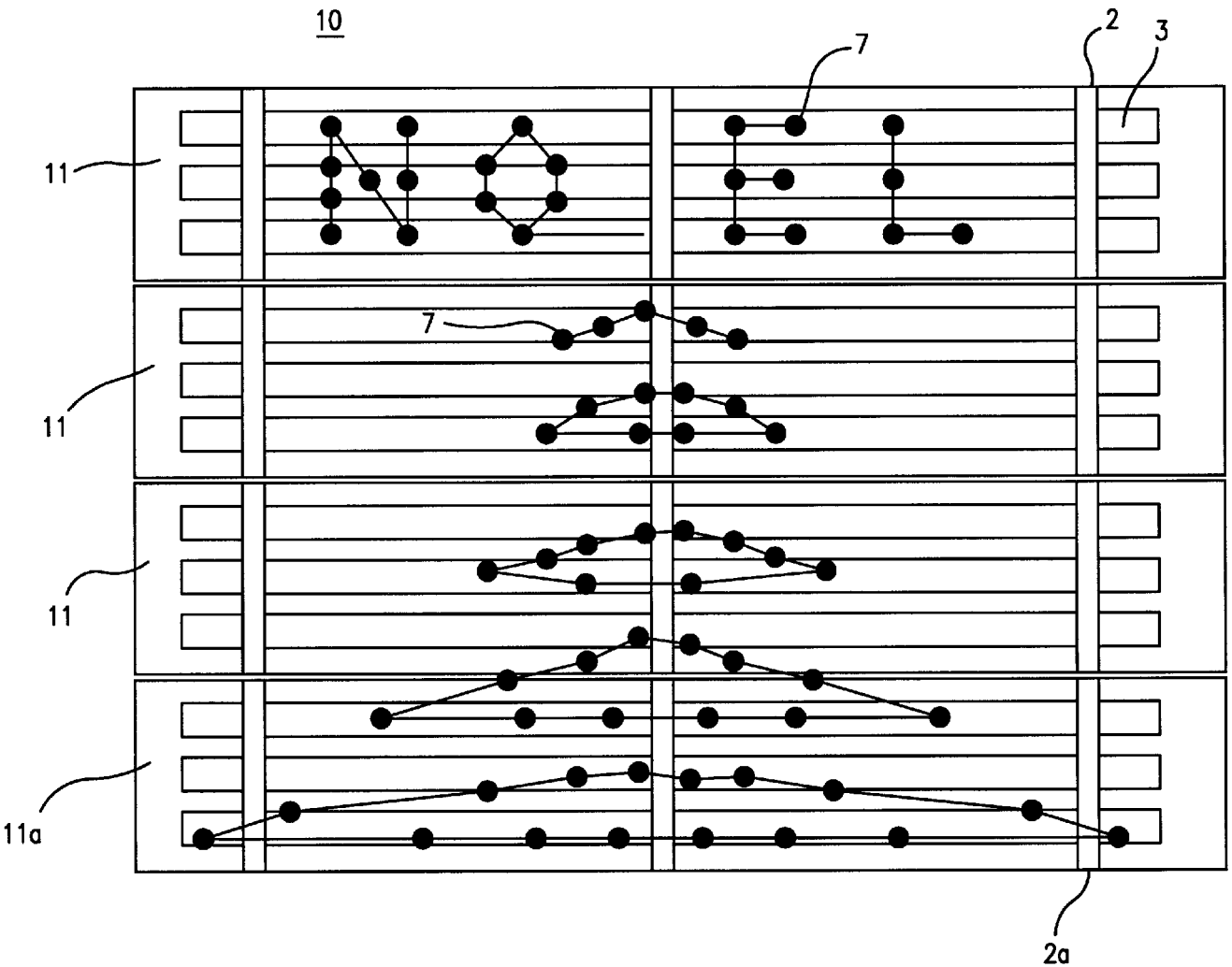
FIG. 3 is a front view of a sectional overhead garage door having a lattice structure and decorative lighting display thereon in accordance with the present invention.
Figure 4:
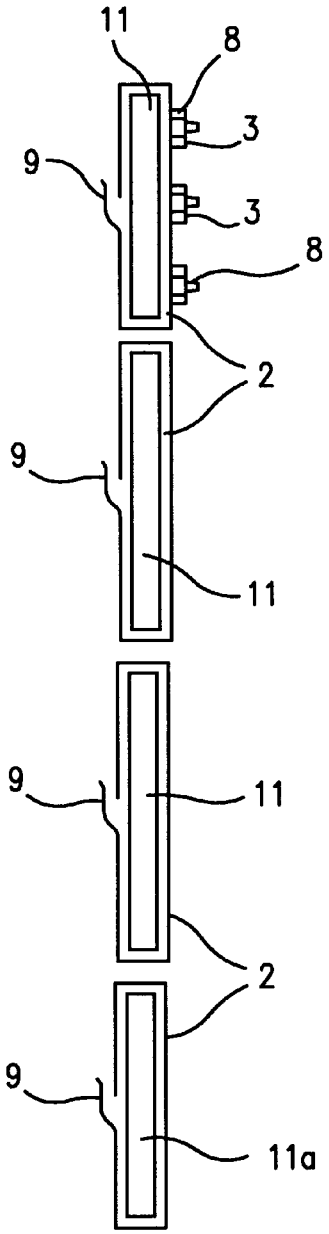
FIG. 4 is a side cross-sectional view of the lattice structure, display and door of FIG. 3 taken along the line 3–3A.

In a preferred embodiment, the apparatus of the present invention provides a method and structure for a removable display on a sectional overhead garage door 10 as depicted in FIGS. 3 and 4. In the example shown in FIG. 3, a series of lights 7 are configured in the form of a Christmas greeting. The lights 7 are attached to the horizontal members 3, as shown in FIG. 4, with the aid of split pin connectors 8 (FIG. 6).

Figure 6:
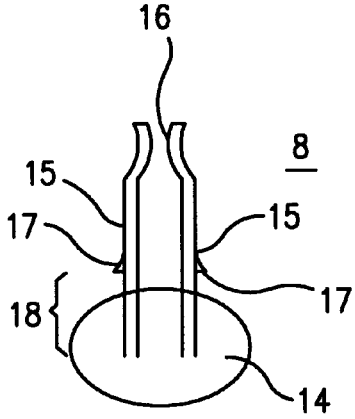
FIG. 6 is a perspective view of a split pin connector for the removable attachment of lights or other display items.

Split pin connectors 8 shown in FIG.6, may be used as a means of attachment of the vertical and horizontal members of the lattice, as shown in FIG. 4, and in addition, as an attachment point for decorative objects such as lights. The split pin connectors are preferably of plastic, constructed with a base 14 and two arms 15 projecting therefrom with a spring connection at the outer end thereof. In use the connectors may be pressed through holes in the vertical and horizontal members to form an attachment of the members. The projecting arms 15 are provided with a wedge 17 spaced sufficiently from the base 14 to provide a space 18 to hold the horizontal and vertical members in place with the wedge 18 holding them in place. The connectors are removed for disassembly by pressing arms 15 together and sliding the connector 8 back through the holes in the horizontal and vertical members.

Figure 5:
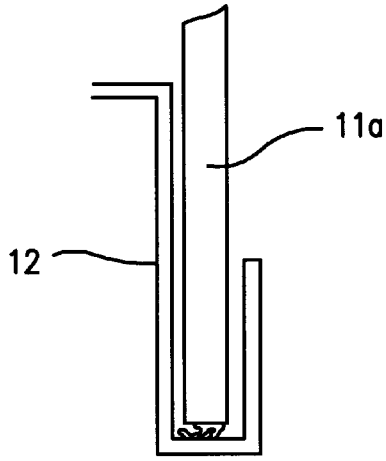
FIG. 5 is a cross-sectional view of a bottom panel of a sectional garage door showing an electrical cord conduit.

Because of the sectional construction of the garage door 10, (FIGS. 3 and 4) the vertical members 2 are looped around each panel 11 of the door, and are secured at the back side of the panel, forming the basis for a separate lattice structure on each panel. The vertical members 2 forming a loop around each panel 11 may be joined at the back side of the panel by hook and loop fasteners 9 as shown in FIG. 4. The horizontal members 3 are removably attached to the vertical members 2 by means of split pin connectors 8. The split pin connectors 8 may also serve as an attachment for lights 7. When a lighting display is to be created on the outer face of a sectional garage door, an electrical cord (not shown), to supply power to the lights may be routed safely and conveniently through a conduit 12 attached to the bottom panel 11*a*. (FIG. 5)

Although the invention has been described with reference to various preferred embodiments thereof, it will be understood by those skilled in the art that various changes and modifications in form and detail may be made without departing from the spirit and scope of the invention.

What is claimed is:

1. A sectional overhead garage door comprising a multiplicity of horizontal panels, at least one panel having a removable lattice structure on an outer face thereof, said lattice structure being formed of vertical and horizontal members, each of said vertical members extending around a top and bottom of said panel and having ends detachably joined at an inner face of said panel to form a complete loop; said vertical members being flexible and sufficiently thin at a portion thereof that extends around the top and bottom of said panel that it will not interfere with the opening and closing of said door; said horizontal members extending horizontally along the outer face of the panel and being removably attached to said vertical members to form a lattice structure; said lattice structure having means for detachably holding a display.

2. An apparatus according to claim 1 herein the ends of said vertical members are detachably joined by hook and loop fasteners.

3. An apparatus according to claim 1 wherein said horizontal members are detachably fixed to said vertical members by hook and loop fasteners.

4. An apparatus according to claim 1 wherein said horizontal members are detachably fixed to said vertical members by split pin connectors.

5. An apparatus according to claim 1 including a lighting display held to said lattice structure by said split pin connectors.

6. A sectional overhead garage door according to claim 1 wherein a portion of each of said vertical members that is positioned at said outer face is rigid and a portion that extends around the top and bottom of said panel is flexible.

7. A sectional overhead garage door according to claim 1 wherein said horizontal; members are removably attached to said vertical members by split pin connectors.

* * * * *